US006564391B2

(12) United States Patent
Shwartz et al.

(10) Patent No.: US 6,564,391 B2
(45) Date of Patent: May 20, 2003

(54) HEADGEAR WITH BALL MARKER

(75) Inventors: Kenneth A. Shwartz, Mattapoisett, MA (US); Charles Lord, Mattapoisett, MA (US)

(73) Assignee: Ahead Headgear, New Bedford, MA (US)

( * ) Notice: Subject to any disclaimer, the term of this patent is extended or adjusted under 35 U.S.C. 154(b) by 0 days.

(21) Appl. No.: 09/921,316

(22) Filed: Aug. 2, 2001

(65) Prior Publication Data

US 2003/0024032 A1 Feb. 6, 2003

(51) Int. Cl.[7] ..... A42B 1/24
(52) U.S. Cl. ..... 2/209.13; 224/918
(58) Field of Search ..... 2/10, 12, 195.1–195.4, 2/175.1, 209.13; 224/918; 40/329

(56) References Cited

U.S. PATENT DOCUMENTS

| | | | | |
|---|---|---|---|---|
| 3,136,547 A | * | 6/1964 | Schaper | 2/300 |
| 3,208,123 A | * | 9/1965 | Koos | 224/163 |
| 4,885,195 A | | 12/1989 | Change, III | 428/36.1 |
| 5,295,683 A | | 3/1994 | Tate | 273/32 A |
| 5,305,999 A | | 4/1994 | Tate | 273/32 B |
| 5,572,773 A | | 11/1996 | Bauer | 24/303 |
| 5,715,539 A | | 2/1998 | Benecki et al. | 2/160 |
| 5,722,126 A | | 3/1998 | Reiter | 24/303 |
| 5,740,557 A | | 4/1998 | Reid et al. | 2/209.13 |
| 5,898,943 A | | 5/1999 | Kim | 2/161.2 |
| 5,898,946 A | | 5/1999 | Keating et al. | 2/209.13 |
| 5,930,839 A | | 8/1999 | Schupp | 2/209.13 |
| 5,950,239 A | | 9/1999 | Lopez | 2/115 |
| 5,996,116 A | | 12/1999 | Tate | 2/12 |
| 6,006,363 A | | 12/1999 | Karlin | 2/228 |
| 6,119,273 A | * | 9/2000 | Cho | 2/183 |
| 6,163,889 A | | 12/2000 | Tate | 2/209.13 |
| 6,170,088 B1 | | 1/2001 | Tate | 2/209.13 |
| 6,253,974 B1 | * | 7/2001 | Park | 224/163 |

FOREIGN PATENT DOCUMENTS

| | | |
|---|---|---|
| EP | 1 000 563 A1 | 5/2000 |
| GB | 2 353 204 A | 2/2001 |

OTHER PUBLICATIONS

International Search Report Completed on July 10, 2002 and mailed on September 10, 2002.

* cited by examiner

*Primary Examiner*—John J. Calvert
*Assistant Examiner*—Katherine Moran
(74) *Attorney, Agent, or Firm*—Foley Hoag LLP

(57) ABSTRACT

A headgear designed for releasably securing a golf ball marker by magnetic attraction is provided. The headgear includes a head band, a head strap attached to the head band for adjusting a circumference of the head band, and a buckle through which the head strap extends for securing an adjusted position of the head strap. The buckle is designed to releasably secure a golf ball marker thereto by magnetic attraction.

13 Claims, 3 Drawing Sheets

HEADGEAR WITH BALL MARKER

TECHNICAL FIELD

The present invention relates generally to headgear, for examples caps and visors, and more particularly, to golf caps or visors having a head-strap buckle which permits placement of a golf ball marker thereon.

BACKGROUND ART

When playing golf, once the golf balls have reached the putting green, it may be necessary to provide a putting player with a putting path that is without interference from another ball that may be positioned between the ball of the putting player and the hole. To remove this potential interference, the usual practice is to temporarily remove the interfering ball and replace it with a ball marker to mark the correct position of the interfering ball. Once it is the turn of the player with the interfering ball to play, the marker may be removed and the ball replaced to its correct position, ready to be putted.

Often, players use coins or other similar small objects to mark the position of the ball, so as to not create any unnecessary interference with the putting path of the putting player. However, as it may be the case, there may be occasions when a coin or a marking object is not readily available. The resulting search for a suitable ball marker can lead to a delay of the game, not only for the group, but for subsequent groups of players on the course.

Many articles have been provided for holding golf ball markers. For instance, golf ball markers have been provided on golf gloves, wrist bands, clothing, divot repair tools, and other golf accessories. However, in many instances, these articles are designed such that they may need to be worn in places that may be uncomfortable for the player, require the player to remember to bring along each time he goes out to play a round of golf, not easily accessible to the player, or are sufficiently small that they are easily lost.

Accordingly, there remains a need for a convenient way to carry a golf ball marker that is easily accessible by the player, and which minimizes the risk of the golf ball marker being lost or misplaced.

SUMMARY OF THE INVENTION

The present invention, in accordance with one embodiment, provides a headgear,l forexample, a visor or a cap which permits placement of a golf ball marker thereon. The headgear, as provided, can include a headband for placement circumferentially about a head of a person. The headgear can also include a bill portion being attached at its proximal end to the band. As the head size may vary from person to person, the headgear of the present invention may include a head strap which permits adjustment of the headband. The headgear may also include a buckle through which the head strap extends for securing the adjusted position of the head strap. The buckle, in one embodiment, may be designed to releasably secure thereto a golf ball marker by magnetic attraction.

In accordance with another embodiment of the present invention, a golf headgear is provided. The headgear includes a headband for placement circumferentially about a head of a person. The headgear can also include a head strap to permit adjustment of the headband. The headgear further includes a buckle through which the head strap extends for securing the adjusted position of the head strap, and a golf ball marker designed to be releasably secured to the buckle by magnetic attraction.

In a further embodiment, a method of releasably securing a golf ball marker to a headgear is provided. The method includes providing a headgear having a headband, a head strap for adjustment of the headband, and a buckle through which the head strap extends and for securing the adjusted position of the head strap. Subsequently, a golf ball marker may be placed on the buckle and permitted to be releasably secured to the buckle by magnetic attraction.

DETAILED DESCRIPTION OF SPECIFIC EMBODIMENTS

The present invention provides, in one embodiment, a headgear which permits the releasably securing of a golf ball marker in a convenient and easily accessible location on the headgear, so as to allow a player to quickly retrieve the marker when needed and return the marker when not in use. The headgear of the present invention may either be a visor or a cap.

Figure 1:
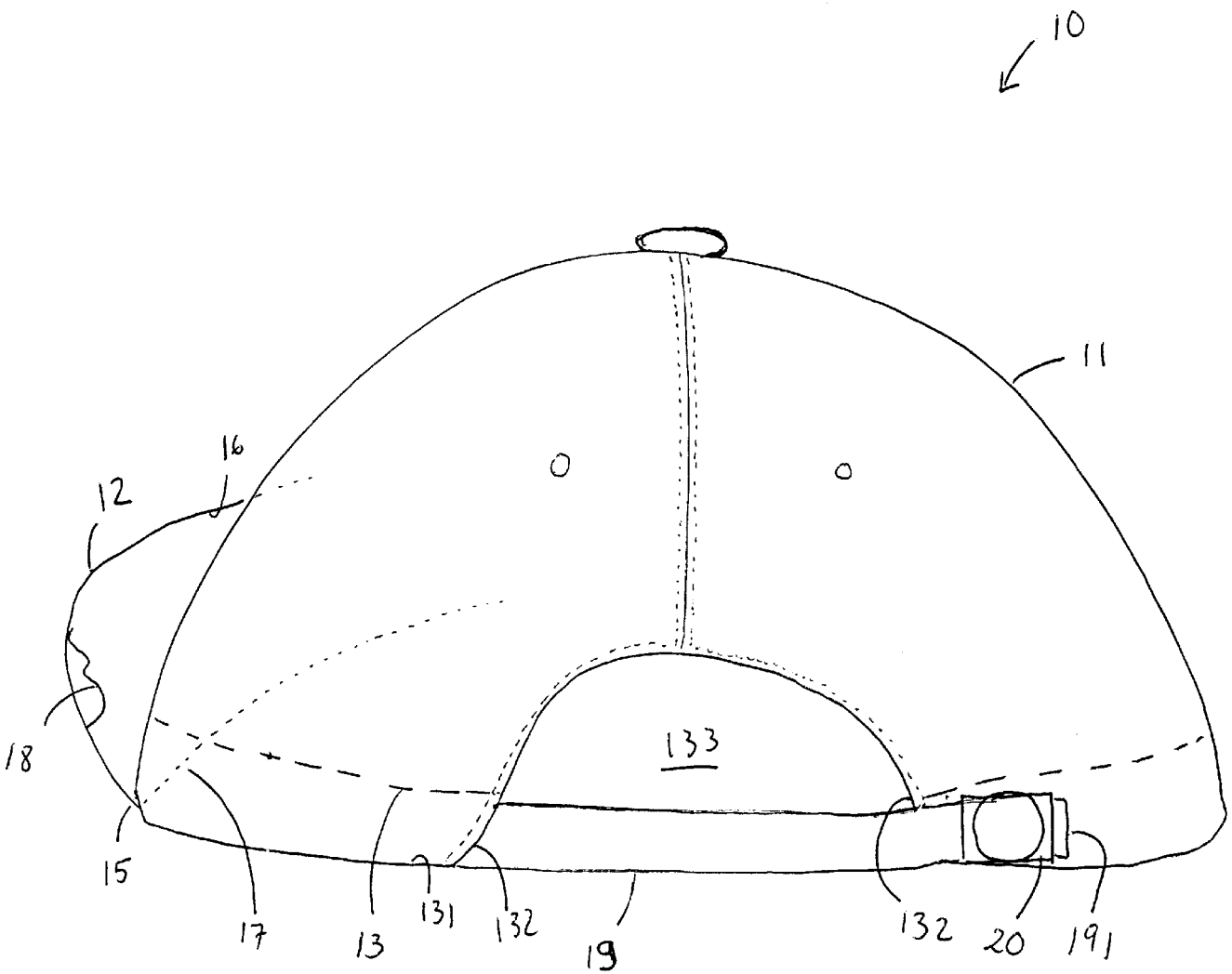
FIG. 1 illustrates a perspective rear view of a headgear in accordance with one embodiment of the present invention.

In FIG. 1. there is shown a cap 10 having a crown portion 11 and a bill portion 12 attached thereto. The crown portion 11, in general, may be used for placement on to a head of a person. The bill portion 12, on the other hand, may be characterized by a substantially rigid material, such as hard plastic or cardboard, to permit the bill portion 12 to adequately maintain its shape.

The bill portion 12, as shown in FIG. 1, includes a proximal end 15 and a distal end 16. The proximal end 15 may be designed to have a curvature 17 which complements the curvature about the periphery of the crown portion 11, so that the bill portion 12 may be closely attached at its proximal end 15 to the crown portion 11. It should be appreciated.that the curvature 17 may vary according to the size of the crown portion 11, and in particular, the circumference of the crown portion 11, so long as the curvature 17 is maintained in a manner which permits a complementary fit about the periphery of the crown portion 11.

The bill portion 12, in one embodiment, is preferably overlaid with a piece of covering 18. To provide the covering 18 with a secure fit over the bill portion 12, the covering 18 may be sewn directly on to the bill portion 12. Alternatively, the covering 18 may be tightly stretched over the bill portion, and the covering 18 and bill portion 12 sewn to the crown portion 11. If desired, the covering 18 may be of the same material and color from which the crown 11 is made. Otherwise, the covering 18 may be of a different material and color from which the crown 11 is made. In an embodiment, the material from which the covering 18 may be made includes cotton fabric, polyester fabric, plastic, or other commercially available material typically used in the manufacturing of headgear or clothes.

Still looking at FIG. 1, the cap 10 may also include a headband 13, secured to the crown portion 11, and designed for placement circumferentially about a head of a person (not shown). To allow attachment of the headband 13 to the crown portion 11, the crown portion 11 may include a lower periphery 131 against which the band 20 may be secured. The headband 13 may include opposing ends 132 defining a space 133 therebetween. By providing the headband 13 with opposing ends 132, different size heads may be accommodated when the ends 132 are adjusted relative to one another.

To adjust the position of the ends 132 relative to one another, a head strap 19 may be provided. Head strap 19, as shown in FIG. 1, may include a free end 191 and an attached end 192, which may be attached to one opposing end 132 of the headband 13. In this manner, should it be necessary to tighten the circumference of the headband 13 to accommodate a different head size, the head strap 19 may be pulled from the free end 191 to adjust a distance between opposing ends 132 across space 133.

Figure 2:
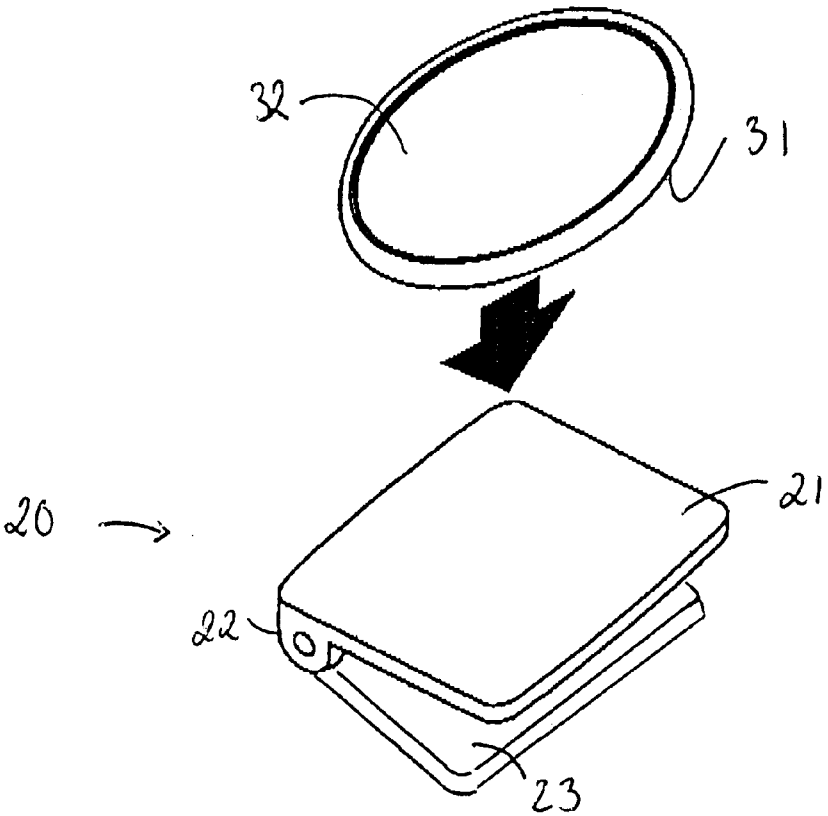
FIG. 2 illustrates a top view of a buckle on the headgear shown in FIG. 1.
Figure 3:
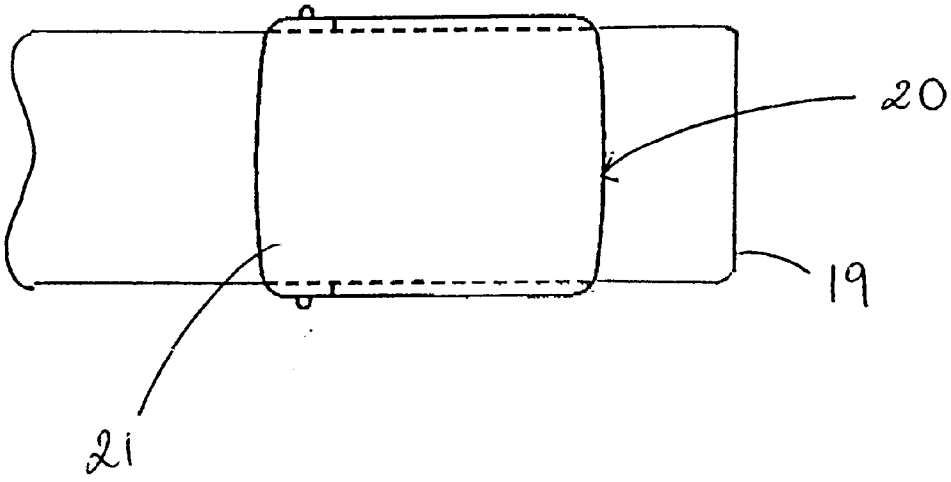
FIG. 3 illustrates a manner in which a golf ball marker may be placed on to the buckle in FIG. 2.

In order to secure the position head strap 19 once it has been adjusted, cap 10 may be provided with a buckle 20 positioned on the crown portion 11. Buckle 20, as shown in FIGS. 2 and 3, may be a conventional head strap buckle having a first member 21 pivotally attached at an end 22 to a second member 23. When the first member 21 is pivoted away from the second member 23, buckle 20 is in a release position, and a slot (not shown) of adequate size is provided at pivot end 22 between the first member 21 and the second member 23 of buckle 20 through which the head strap 19 may extend. Once the desired adjusted position of the head strap 19 has been attained, the first member 21 may be pushed back against the second member 23 to reposition the buckle 20 to a closed position. In the closed position, the size of the slot at pivot end 22 is sufficiently smaller, so that the head strap 19 may be securely held between the first member 21 and the second member 23 of buckle 20, as illustrated in FIG. 3.

It should be noted that although the head strap 19 is shown as a single strap extending across space 133, other designs may be used. For instance, a two-head-strap design may be used with each strap attached to one opposing end 132 of headband 13. In such an embodiment, each free end of the head straps may be pulled toward one another to adjust the circumference of the headband 13. A buckle 20 may be attached to one of the two head straps to maintain and secure the adjusted position to the head straps.

The buckle 20, in accordance with one embodiment of the present invention, may be manufactured to releasably secure a golf ball marker by magnetic attraction. As illustrated in FIG. 2, there is shown buckle 20 and a golf ball marker 30. To releasably secure the golf ball marker 30 to the buckle 20 by magnetic attraction, the present invention provides various embodiments for which this may be accomplished. For instance, in one embodiment, the golf ball marker 30 may be made from a magnetic material, while the buckle 20 may be made out of a material capable of attracting a magnetic material. In another embodiment, the buckle 20 may be made from a magnetic material, while the golf ball marker 30 may be made from a material capable of attracting a magnetic material. In a further embodiment, both the buckle 20 and the golf ball marker 30 may be made from a magnetic material.

Figure 4:
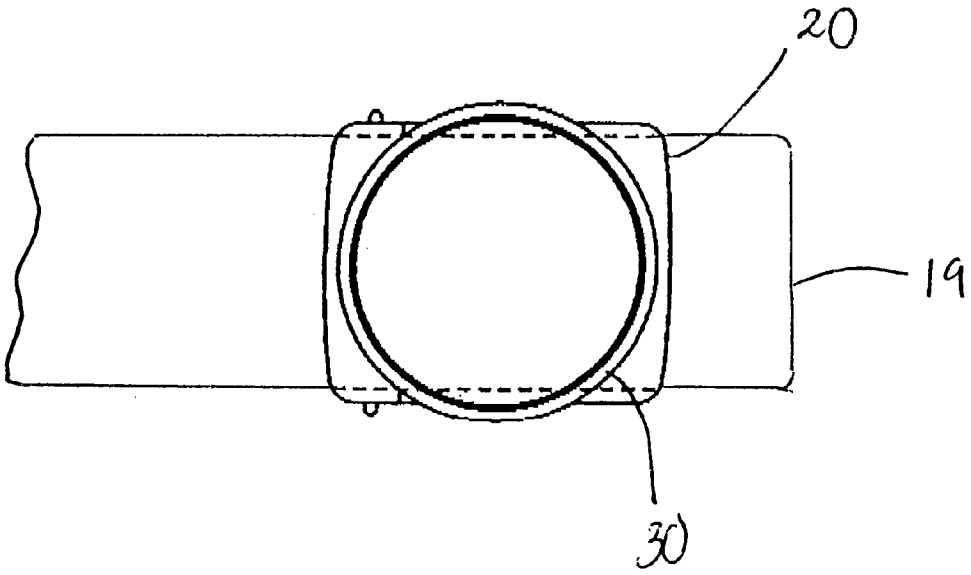
FIG. 4 illustrates a top view of the buckle in FIG. 2 having a golf ball marker thereon.

In the embodiment wherein the ball marker 30 may be made from a magnetic material, the ball marker 30 may be provided with a magnetic surface 31 for engagement with the buckle 20 and an outer surface 32. The magnetic surface 31, in one embodiment, may be designed to include a magnetic metal, a ferromagnetic metal and/or a non-metal magnetic material to permit attraction to a metallic buckle 20. In addition, if it is desired, the outer surface 32 may be made from a material different from the magnetic surface 31, and may be used to display graphics thereon. In one embodiment, the outer surface 31 may include a removable top to permit exchange of displays provided on the golf ball marker 30. The magnetic surface 31 and the outer surface 32 may be manufactured with a similar geometric shape, for instance, a circular design, as shown in FIGS. 2 and 4. Alternatively, the magnetic surface 31 and the outer surface 32 may having different geometric designs, so long as the magnetic surface 31 remains capable of being securely attracted to the buckle 20.

In the embodiment wherein the buckle 20 may be made from a magnetic material, the first member 21 of buckle 20 may be designed to include magnetic metal, ferromagnetic metal and/or a non-metal magnetic material to permit attraction thereto of a metallic golf ball marker 30. The ball marker 30, on the other hand, may be made entirely from a metallic material capable of being attracted to the magnetic buckle 20, or may be designed so that surface 31 is provided with a metallic material for attachment to the magnetic buckle 20, while providing an outer surface 32 that is made from a material different from the surface 31. The outer surface 32, as noted above, may be used to display graphics thereon, and may include the various embodiments discussed in connection with a magnetic ball marker 30 above.

In further embodiment, both the buckle 20 and the ball marker 30 may be made to include magnetic metal, ferromagnetic metal and/or a non-metal magnetic material to permit the releasable engagement between the buckle 20 and the ball marker 30 by magnetic attraction.

As shown in FIG. 4, regardless of the embodiment employed, it should be appreciated that the magnetic attraction between the buckle 20 and the ball marker 30 must be sufficient to securely hold the ball marker 30 on to the buckle 20, such that normal head movement by a player during play will not act to dislodge the ball marker 30 from the buckle 20. To enhance the secure engagement between the buckle 20 and the ball marker 30, it may be desirable to provide the buckle 20 with, for instance, an indentation (not shown) sufficient to receive the ball marker 30 therein, so that potential sliding of the ball marker 30 on the buckle 20 can be minimized. Such indentation, in one embodiment, may be of a depth which permits the protrusion of the ball marker 30 therefrom to allow a player to easily locate and remove the ball marker 30 from the buckle 20. The indentation, in one embodiment, may include a magnetic surface for attracting thereto a ball marker made from a material capable of attracting a magnetic material. Alternatively, the indentation may be made from a material capable of attracting a magnetic golf ball marker. Of course, both the indentation and the golf ball marker may be magnetic for releasably securing the golf ball marker within the indentation.

In another embodiment, a small pin (not shown) may be provided on either the surface 31 of ball marker 30 or on the first member 21 of buckle 20 with a corresponding aperture in either the first member 21 or the surface 31 for reception of the small pin to enhance the secure engagement between the buckle 20 and the ball marker 30. Of course, other designs may be provided, so long as such designs act to enhance the security of the ball marker 30 on the buckle 20.

The headgear 10 and ball marker 30 provided by the present invention allows a player to conveniently locate and access the ball marker 30 when needed. In particular, the player simply reaches up towards the head strap 19 area of his cap 10 to remove the ball marker 30 from the buckle 20.

The marker 30 may, thereafter, be placed on to the putting green to mark the location of the ball. Subsequently, when it is his turn to putt, the player may pick up the ball marker 30 and return it to the buckle 20, where it is securely held to the buckle 20 by magnetic attraction for subsequent use.

While the invention has been described in connection with the specific embodiments thereof, it will be understood that it is capable of further modification. For example, although reference has been made to a cap 10 throughout, it should be appreciated that a visor can be easily adapted to include the features provided herein. Furthermore, this application is intended to cover any variations, uses, or adaptations of the invention, including such departures from the present disclosure as come within known or customary practice in the art to which the invention pertains, and as fall within the scope of the appended claims.

What is claimed is:

1. A headgear for releasably securing a golf ball marker thereon, the headgear comprising:

a headband having opposing ends spaced from one another for placement circumferentially about a head of a person;

a bill portion being attached at its proximal end to the headband;

a head strap extending across a space between the opposing ends of the headband, for adjusting a distance between the opposing ends across the space to adjust a circumference of the headband; and a buckle designed to releasably secure a golf ball marker thereto by magnetic attraction, and through which one end of the head strap extends for securing the head strap at its adjusted position.

2. A headgear as set forth in claim 1, wherein the buckle is made from a material which attracts a magnetized golf ball marker.

3. A head gear as set forth in claim 2, wherein the material is metallic.

4. A headgear as set forth in claim 1, wherein the buckle is made from a magnetic material.

5. A headgear as set forth in claim 4, wherein the magnetic material includes one of a magnetic metal, ferromagnetic metal or a non-metal magnetic material.

6. A golf headgear comprising:

a headband having opposing ends spaced from one another for placement circumferentially about a head of a person;

a head strap extending across a space between the opposing ends of the headband, for adjusting a distance between the opposing ends across the space to adjust a circumference of the headband;

a buckle for placement of a golf ball marker thereon and through which one end of the head strap extends for securing the head strap at its adjusted position; and a golf ball marker releasably secured to the buckle by magnetic attraction.

7. A headgear as set forth in claim 6, wherein the buckle is made from a metallic material.

8. A head gear as set forth in claim 7, wherein the golf ball marker includes one of a ferromagnetic metal or a non-metal magnetic material.

9. A headgear as set forth in claim 6, wherein the buckle is made from a magnetic material.

10. A headgear as set forth in claim 9, wherein the magnetic material includes one of a ferromagnetic metal or a non-metal magnetic material.

11. A method for releasably securing a golf ball marker to a headgear, the method comprising:

providing a headgear having a head band, a head strap attached to the head band for adjusting a circumference of the head band, and a buckle through which the head strap extends for securing an adjusted position of the head strap, the buckle being designed to releasably secure a golf ball marker thereto by magnetic attraction;

placing a golf ball marker on to the buckle; and allowing the golf ball marker to be releasably secured to the buckle by magnetic attraction.

12. A method as set forth in claim 11, wherein the step of providing includes providing the buckle with magnetic property.

13. A method as set forth in claim 11, wherein in step of allowing includes providing the golf ball marker with magnetic property.

* * * * *